US010857419B2

(12) United States Patent
Solodovnik et al.

(10) Patent No.: US 10,857,419 B2
(45) Date of Patent: Dec. 8, 2020

(54) ELLIPTICAL EXERCISE DEVICE FOR SIMULTANEOUS TRAINING OF SHOULDER GIRDLE, PELVIC GIRDLE AND TRUNK MUSCLES IN A HUMAN

(71) Applicant: TIGERSTEP FITNESS SE, Prague (CZ)

(72) Inventors: Sergii Anatoliyovich Solodovnik, Prague (CZ); Oleg Vietrov, Kyiv (UA)

(73) Assignee: TIGERSTEP FITNESS SE, Prague (CZ)

( * ) Notice: Subject to any disclaimer, the term of this patent is extended or adjusted under 35 U.S.C. 154(b) by 0 days.

(21) Appl. No.: 15/579,942

(22) PCT Filed: Dec. 21, 2016

(86) PCT No.: PCT/UA2016/000148
§ 371 (c)(1),
(2) Date: Dec. 6, 2017

(87) PCT Pub. No.: WO2017/184100
PCT Pub. Date: Oct. 26, 2017

(65) Prior Publication Data

US 2018/0221705 A1 Aug. 9, 2018

(30) Foreign Application Priority Data

Oct. 10, 2016 (UA) ..... 2016 10279

(51) Int. Cl.
*A63B 22/00* (2006.01)
*A63B 22/06* (2006.01)
*A63B 69/00* (2006.01)

(52) U.S. Cl.
CPC ..... *A63B 22/0005* (2015.10); *A63B 22/0012* (2013.01); *A63B 22/0023* (2013.01);
(Continued)

(58) Field of Classification Search
CPC ..... A63B 22/0012; A63B 22/06–0694; A63B 23/0233; A63B 23/0238; A63B 31/18;
(Continued)

(56) References Cited

U.S. PATENT DOCUMENTS 3,057,201 A * 10/1962 Jaeger ..... C08L 89/06 73/379.07
4,688,791 A * 8/1987 Long ..... A63B 22/001 482/112
(Continued)

FOREIGN PATENT DOCUMENTS

EP 0323023 A2 7/1989
GB 2371997 B * 12/2001
(Continued)

OTHER PUBLICATIONS

International Search Report in International Application No. PCT/UA2016/000148, filed Dec. 21, 2016.
(Continued)

*Primary Examiner* — Nyca T Nguyen
(74) *Attorney, Agent, or Firm* — Saliwanchik, Lloyd & Eisenschenk

(57) ABSTRACT

The invention relates to the field of sports and medicine, specifically to training devices, more particularly to an elliptical exercise device suitable for simultaneous training of shoulder and pelvic girdle muscles in a human. Accordingly, it is desirable to provide an exercise device for training trunk muscles, the shoulder girdle and the pelvic girdle in a human and, at the same time, to enable simulation of various motion patterns by activating different groups of muscles, joints, the locomotor system in a human in general and especially muscles which hold the vertebral spine. It is further desirable to enable optional correction of their load during the process of coordination of motor activity (locomotion) of the human body through simultaneous elliptical
(Continued)

motions of hands and feet, which, in addition to the load on the shoulder girdle and the pelvic girdle muscles, simultaneously provide preferably stretching load on muscle groups which hold the vertebral spine.

6 Claims, 3 Drawing Sheets

(52) U.S. Cl.
CPC ..... *A63B 22/0046* (2013.01); *A63B 22/0664* (2013.01); *A63B 69/0057* (2013.01); *A63B 2022/0028* (2013.01); *A63B 2022/067* (2013.01); *A63B 2022/0617* (2013.01); *A63B 2225/09* (2013.01); *A63B 2225/093* (2013.01)

(58) Field of Classification Search
CPC . A63B 35/10; A63B 22/0005; A63B 22/0023; A63B 22/0046; A63B 22/0664; A63B 2225/09; A63B 69/0057; A63B 2022/0028; A63B 2022/0617; A63B 2022/067; A63B 2225/093
See application file for complete search history.

(56) References Cited

U.S. PATENT DOCUMENTS 4,693,468 A * 9/1987 Kurlytis ..... A63B 21/0004 482/130
4,842,269 A * 6/1989 Huang ..... A63B 22/0002 482/115
5,044,627 A * 9/1991 Huang ..... A63B 22/0002 482/115
5,269,736 A * 12/1993 Roberts ..... A63B 23/03516 482/51
5,685,804 A * 11/1997 Whan-Tong ..... A63B 22/001 482/51
5,785,631 A * 7/1998 Heidecke ..... A63B 22/001 482/4
5,857,943 A * 1/1999 Murray ..... A63B 22/0012 482/57
5,916,065 A * 6/1999 McBride ..... A63B 22/001 482/51
5,947,874 A 9/1999 Dougherty
6,017,294 A 1/2000 Eschenbach
6,123,650 A 9/2000 Birrell
6,146,313 A 11/2000 Whan-Tong et al.
6,165,107 A 12/2000 Birrell
6,749,540 B1 6/2004 Pasero et al.
6,811,517 B1 11/2004 Eschenbach
7,014,595 B2 * 3/2006 Bruno ..... A63B 22/203 482/51
7,033,306 B2 * 4/2006 Graber ..... A63B 22/0664 482/52
7,691,034 B2 4/2010 May et al.
7,704,192 B2 4/2010 Dyer et al.
7,731,635 B2 6/2010 Dyer
7,993,247 B1 * 8/2011 Eschenbach ..... A63B 22/001 482/51
8,419,598 B2 4/2013 Dyer et al.
9,272,181 B2 3/2016 Arnold et al.
2004/0235621 A1 11/2004 Eschenbach
2006/0199701 A1 9/2006 May et al.
2007/0161463 A1 * 7/2007 Eschenbach ..... A63B 22/001 482/52
2013/0065732 A1 3/2013 Hopp
2014/0221166 A1 8/2014 Huang et al.

FOREIGN PATENT DOCUMENTS

RU 2155622 C1 9/2000
RU 108311 U1 9/2011
WO WO-02051504 A2 * 7/2002 ..... A63B 22/0012

OTHER PUBLICATIONS

"Elliptical Upper-Body Motion Analysis," Octane Fitness: White Paper, pp. 1-2, https://www.octanefitriess.com/home/wp-content/uploads/sites/2/2014/01/convergearmswpfinal.pdf.
"Elliptical Upper-Body Motion Analysis," Octane Fitness: White Paper, Feb. 1, 2014, pp. 1-2, https://www.octanefitness.com/home/wp-content/uploads/sites/2/2014/01/convergearmswpfinal.pdf.

* cited by examiner

ELLIPTICAL EXERCISE DEVICE FOR SIMULTANEOUS TRAINING OF SHOULDER GIRDLE, PELVIC GIRDLE AND TRUNK MUSCLES IN A HUMAN

FIELD OF THE INVENTION

The invention relates to the field of sports and medicine, specifically to training devices, more particularly to an elliptical exercise device suitable for simultaneous training of shoulder and pelvic girdle muscles in a human with a possibility of simultaneous activation of different muscle groups, joints and the locomotor system in general.

BACKGROUND OF THE INVENTION

To date there are many various types of elliptical exercise device that combine properties of an exercise bicycle and those of a treadmill, enable a user to rotate feet back and forth along the trajectory of an ellipse, not a circle, so knee joints are exposed to less load. Elliptical exercise device allow users to strengthen the respiratory and cardiovascular systems, to lose weight efficiently, to produce a general healing effect.

However, the vast majority of them are designed so as to comprise a leg load unit, which provides elliptical motions of feet, and an arm load unit, which provides reciprocating motions of hands, so that training on such exercise devices allows a user to achieve, besides workout of leg muscles, rotation and slight flexion and extension of the thoracic segment only, and neither complete rotation, nor flexion and extension of the vertebral spine are achieved, and, therefore, no comprehensive simulation of different motion patterns is provided. There are a lot of known elliptical exercise devices, including those disclosed in the following patents: U.S. Pat. No. 6,123,650A published on Sep. 26, 2000, U.S. Pat. No. 6,146,313A published on Nov. 14, 2000, U.S. Pat. No. 6,165,107A published on Dec. 26, 2000, U.S. Pat. No. 6,749,540B1 published on Jun. 15, 2004, U.S. Pat. No. 7,704,192B2 published on Apr. 27, 2010, U.S. Pat. No. 7,731,635B2 published on Jun. 8, 2010, U.S. Pat. No. 8,419,598B2 published on Apr. 16, 2013, U.S. Pat. No. 9,272,181B2 published on Mar. 1, 2016 and others; and also U.S. Pat. No. 6,811,517B1 published on Nov. 2, 2004, U.S. Pat. No. 6,017,294 published on Jan. 25, 2000, US20040235621A1 published on Nov. 25, 2004 and https://www.octanefitness.com/home/wp-content/uploads/sites/2/2014/01/convergearmswpfinal.pdf, which are designed so as to comprise an arm load unit providing elliptical motions of hands.

The disadvantages of know solutions are that they employ a leg load unit, which provides elliptical motions of feet, and an arm load unit, which provides reciprocating motions of hands, so that training on such exercise devices allows a user to achieve, besides workout of leg muscles, rotation and slight flexion and extension of the thoracic segment only, and neither complete rotation, nor flexion and extension of the vertebral spine, nor regulated stretching load on the shoulder girdle muscles, the pelvic girdle muscles and trunk muscles in a human are achieved. Further, the exercise device is designed so that there is no option to incline a human body, namely the spine, from vertical to the ground.

Also known is an exercise device for simultaneous training of the shoulder girdle, the pelvic girdle and trunk muscles in a human, disclosed in patent RU2155622S1 published on Sep. 10, 2000. Such device includes an exercise device body, which includes a load unit, hand and foot pedals adjustable in length. The exercise device is equipped with a removable support for chest and a removable supporting belt. The exercise device body includes two elements: an exercise device stand containing horizontal components and one vertical support and a bar installed therein so that it can be fixed at three main positions. Foot and hand pedals, characterized by kinematic connection provided by sliding telescopic transmission and two gearboxes, are fixed on the bar. Hand and foot pedals are mounted so that they can move along the bar and their relative position can be adjusted as the length of a telescopic transmission changes, and the gearbox, mounted on the axis of hand pedals, is equipped with a mechanism turning on forward and reverse rotation transmission and independent pedal movement, and a RPM sensor. A second gear and a load unit are mounted on the axis of foot pedals.

The disadvantages of this known exercise device is that training on it provides workout of thoracic and lumbar girdle muscles, while comprehensive flexion and extension of the vertebral spine is not achieved. In addition, motion of hands and feet correspond to rotating motions similar to those on a bicycle, i.e. those with the circular trajectory. Such rotating motions allow a user to work out limbs only, rather than all segments of the body.

Another known is an elliptical exercise device for simultaneous training of the shoulder girdle, the pelvic girdle and trunk muscles in a human according to U.S. Pat. No. 7,691,034B2, published on Apr. 6, 2010, having an exercise device body comprising a load unit, foot pedals and at least one swing bracket. Foot pedals connected to the exercise device body move in the orbital trajectory which is approximately parallel to the longitudinal axis. The swing bracket connected to the exercise device body provides reciprocating motion and works independently of foot pedals, and at least one swing bracket comprises the left swing bracket and the right swing bracket.

The disadvantage of this device is that it is designed so that a leg load unit, which provides elliptical motion of feet, and an arm load unit, which provides reciprocating motion of hands, so that training on this exercise device helps to provide, besides work of leg muscles, rotation and slight flexion and extension of the thoracic segment only, and, consequently, no complete rotation, flexion and extension of the spine are achieved. Another drawback is that the design of the exercise device does not provide an opportunity to change an angle of inclination of a human body, namely the spine, from vertical to the ground.

Accordingly, it is desirable to provide an exercise device for training trunk muscles, the shoulder girdle and the pelvic girdle in a human and, at the same time, to enable simulation of various motion patterns by activating different groups of muscles, joints, the locomotor system in a human in general and especially muscles which hold the vertebral spine. It is further desirable to enable optional correction of their load during the process of coordination of motor activity (locomotion) of the human body through simultaneous elliptical motions of hands and feet, which, in addition to the load on the shoulder girdle and the pelvic girdle muscles, simultaneously provide preferably stretching load on muscle groups which hold the vertebral spine.

SUMMARY OF THE INVENTION

Generally, in one aspect, the invention relates to an elliptical exercise device for simultaneous training of the shoulder girdle, the pelvic girdle and trunk muscles in a human. The device comprises an exercise device body, which includes an arm load unit and a leg load unit, with hand and foot pedals being fixed thereon, respectively, the arm load unit and leg load unit are configured to enable hand pedals and foot pedals to perform elliptical motions independently from each other.

In various embodiments and implementations, the elliptical exercise device is configured to change an angle of inclination of a human body from vertical to the ground.

The elliptical exercise device is configured to form an angle between the plane of the trajectory of elliptical motions of hands and the sagittal plane of a human body, XZ.

The elliptical exercise device is configured to change an angle between the plane of the trajectory of elliptical motions of hands and the sagittal plane of a human body, XZ.

The elliptical exercise device is configured to set up kinematic parameters of elliptical motions of hands and feet.

The elliptical exercise device is configured to adjust a distance between roll axes of the arm load unit and the leg load unit.

The elliptical exercise device further comprising a removable supportive platform.

The removable supportive platform preferably located at the level of the chest segment of a human body.

The exercise device was simulated by inventors. The process of testing of the models so designed demonstrated that the simultaneous performance of elliptical motions by legs and reciprocating or circular (cycling) motions by arms allow a user to load the pelvic girdle and the shoulder girdle muscle and, at the same time, to train the heart. The studies however unexpectedly showed that, in addition to loading the pelvic and shoulder girdles when a user performs elliptical motions by legs and arms simultaneously, the muscle system that holds the vertebral spine can be exposed to loads with simultaneous stretching and twisting elements. After a certain course of trainings on the exercise device with simultaneous elliptical motions of feet and hands, it was established that muscles which hold the vertebral spine not only stretched and became more elastic, but also significantly strengthened.

The set of features stated in the claims provides such loads for groups of muscles which hold the vertebral spine so as to allow using the exercise device as a tool for rehabilitation and treatment of people with functional disorders of the vertebral spine.

The causal relationship between the set of essential features of the invention and the technical result achieved with the use of the invention is as follows.

In an elliptical exercise device for simultaneous training of the shoulder girdle, the pelvic girdle and trunk muscles in a human, according to one feature of the invention, the arm load unit and the leg load unit are configured to enable hand pedals and foot pedals to perform elliptical motions independently from each other. The prior art discloses that a leg load unit configured so that a user can perform elliptical motions by feet allows to provide smooth elliptical motions of legs, which simulate natural motions while running, and the pelvic girdle is exposed to the major physical load. However, according to the said feature of the invention claimed, the leg load unit and the arm load unit are configured so as to provide a possibility for a user to perform elliptical motions by hands and feet at the same time, i.e. elliptical motions are performed not only by lower limbs but also by upper limbs. Such configuration of the load units allows a user to ensure workout of the whole body including calf muscles, thigh muscles or quadriceps, gluteal muscles, oblique abdominal muscles, lumbar, back, and arm muscles. Simultaneous elliptic motions performed by hands and feet allow to involve all parts of the body, as ellipticity of hand motions provides training of the shoulder girdle, however in the process of performing these motions trunk muscles are also involved and work by stretching, and the ellipticity of foot motions provides training of both lower limbs and the pelvic girdle. Further, the ellipticity of motions ensures smooth performance of exercises. Thus, configuration of the arm load unit so as to provide a user with a possibility to perform elliptical motions by hands simultaneously with performance of elliptical motions by feet provides preferably stretching load on muscles which hold the vertebral spine by loading lower and upper limbs, and the heart is also trained without high impact on joints.

Besides, elliptical motions of hands and feet might be synchronize, for example, synchronously, movement of the right arm simultaneously with the movement of the right leg and vice versa, etc., or asynchronously, movement of the right arm simultaneously with the movement of the left leg and vice versa, etc. Further, if appropriate and depending on the level of user's training background, elliptical motions may be performed by one hand (either right or left) only to work out only certain muscles of the shoulder girdle. In this case, elliptical motions may be performed both forward and backward during exercises. It depends both on the level of user's training background and the need to perform such exercises according to instructions of a trainer or a doctor.

According to one feature of the invention claimed, the elliptical exercise device is configured to change an angle of inclination of a human body, namely the spine, from vertical to the ground (to the horizontal position). This design of the exercise device allows providing a possibility for different positions of a human body from vertical to the ground, and location of the load is also changed at the same time. The main positions, which are provided, are, firstly, passing the line connecting the axis of the leg load unit and the arm load unit at any angle to the horizontal position, with human movement up or down being simulated with simultaneous performance of elliptical motions of hands or one hand (depending on the need for training and the level of training background) and passing the line connecting the axis of the leg load unit and the arm load unit in parallel to the horizontal position. When passing the line connecting the axis of the leg load unit and the arm load unit at an angle to the horizontal position, when user's movement up is simulated, the load of body weight falls on the vertebral spine, and, when an angle of inclination of a human body changes from vertical to the horizontal, the load of the body weight on the spine decreases, thus allowing to load the system of muscles which hold the spine both in a kinematic way (motion trajectory) and a dynamic way (efforts to perform motions) while the spine remains 'unloaded'.

According to one feature of the invention claimed, the elliptical exercise device is configured to form an angle between the plane of the trajectory of elliptical motions of hands and the sagittal plane of a human body, XZ. This design of the exercise device allows providing such elliptical locomotion of human hands which would simulate motions of cat family members, such as a bobcat, a tiger, when front limbs do not move in parallel to each other, but rather overlap each other at an angle, with a body being bent, stretched in one direction. In the process of such elliptical motion, an arm moves forward from a shoulder towards the sagittal plane, and this raises a possibility for additional loads on the system of muscles which hold the spine.

According to another feature of the invention claimed, the elliptical exercise device is configured to change said an angle between the plane of the trajectory of elliptical motions of hands and the sagittal plane of a human body, XZ. Configuration of the exercise device to provide for a possibility to change the angle allows to change (increase/decrease) the range of traction/stretching exercises in a human body, thereby causing muscles in a human body to stretch. Further, changing an angle between the plane of the trajectory of elliptical motions of hands and the sagittal plane of a human body, XZ, provides a possibility for people with different level of training background and physical abilities to perform exercises on the exercise device. Thus, training on this exercise device provides softness and accuracy of interaction of joints of the locomotor system similar to those seen in the cat family.

According to yet another feature of the invention claimed, the elliptical exercise device is configured to set up kinematic parameters of elliptical motions of hands and feet. The design of the exercise device allows to provide the required position, speed and acceleration of elliptical motions (elliptical trajectory) of hands and feet for both different training exercises and different people.

According to yet another feature of the invention claimed, the elliptical exercise device is configured to adjust a distance between roll axes of the arm load unit and the leg load unit. The design of the exercise device allows a user to adjust the exercise device to the desired comfortable position of hands and feet given different length of arms and legs in different people.

According to yet another feature of the invention claimed, the elliptical exercise device further comprising a removable supportive platform located preferably at the level of chest of a human body. The design of the exercise device with such a platform allows a user to lean on it during breaks in trainings to have some rest and, depending on the level of one's physical abilities, either to use the exercise device and lean on the removable supporting platform, or remove it completely.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
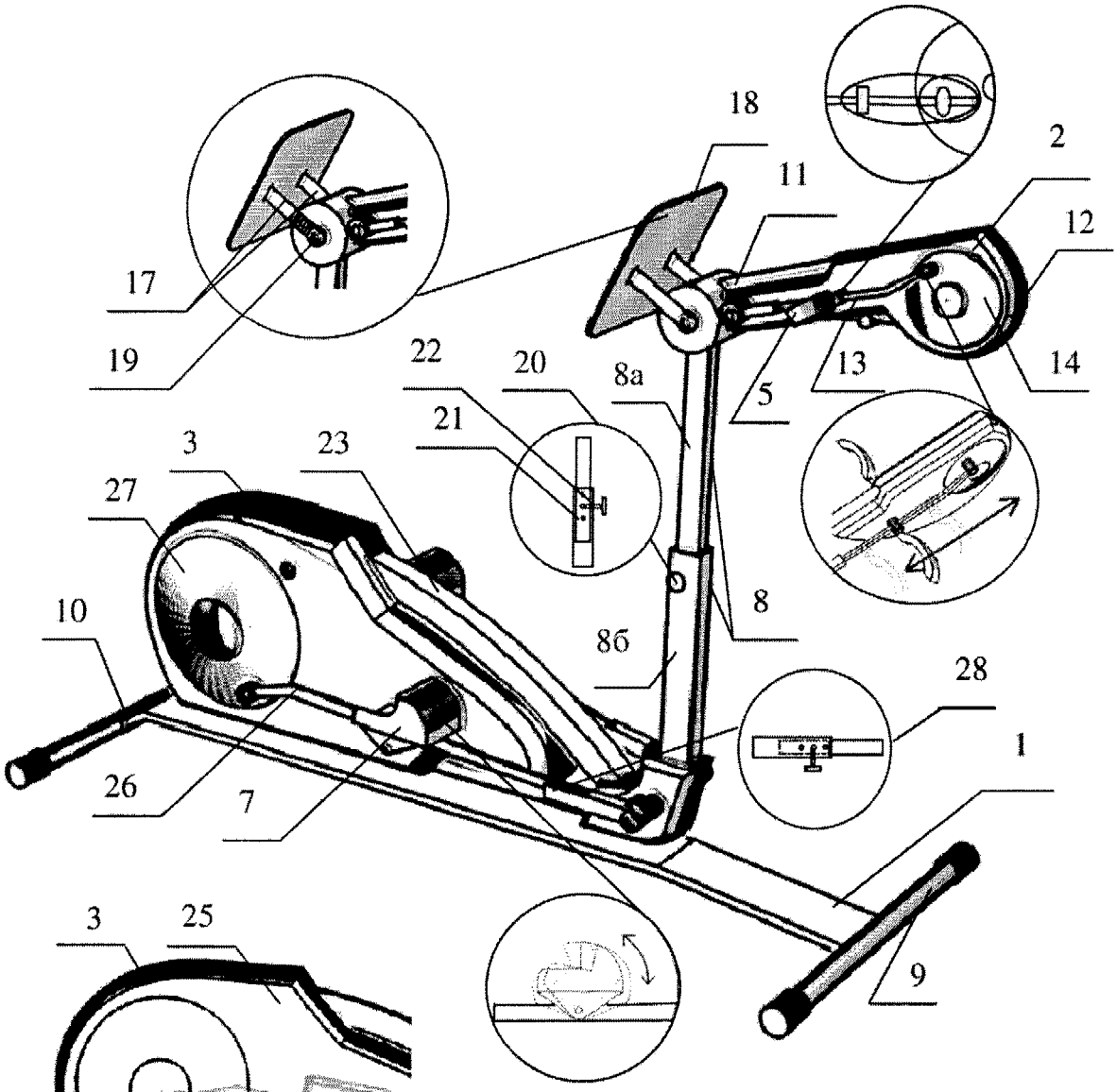
FIG. 1 shows a general view of the exercise device detailing of adjustment of a distance between axes of the arm load unit and the feet load unit with a schematic illustration of elliptical motions with hand pedals.
Figure 2:
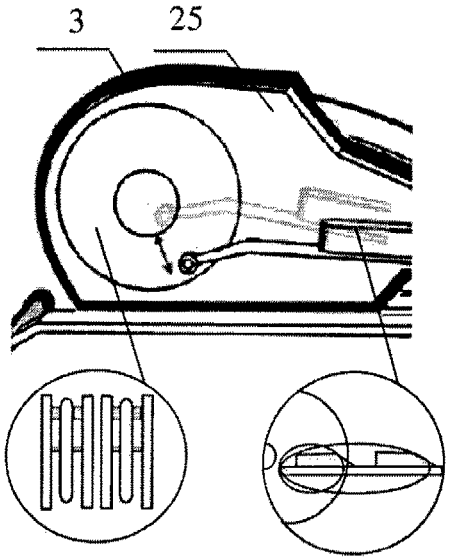
FIG. 2 shows a view of the leg load unit with a schematic illustration of elliptical motions with foot pedals and the flywheel positioned.
Figure 3:
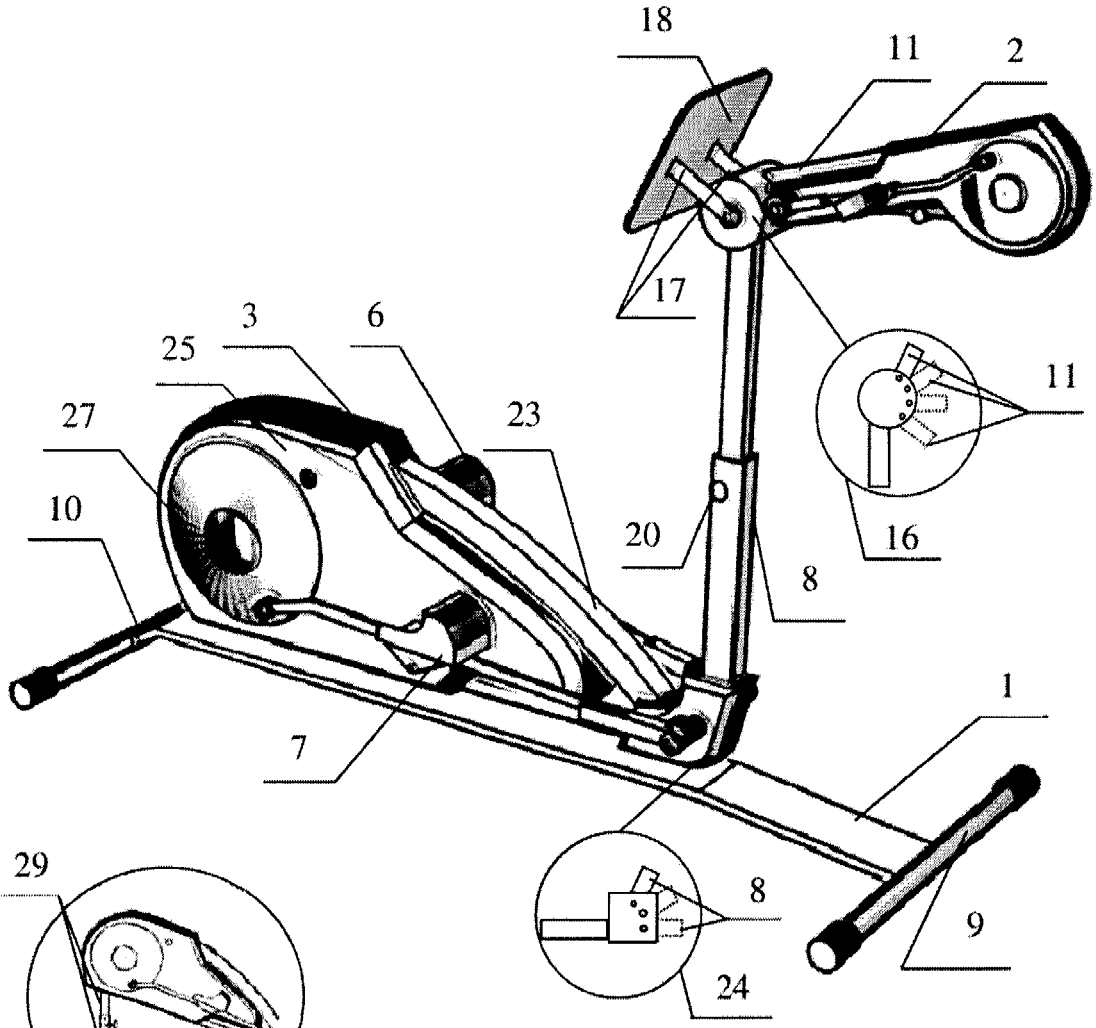
FIG. 3 shows a view of the exercise device detailing the change an angle of inclination of a human body from vertical to the ground.
Figure 4:
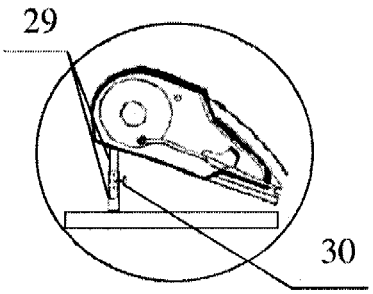
FIG. 4 shows a view of the leg load unit detailing the change an angle of a human body from vertical to the ground.
Figure 5:
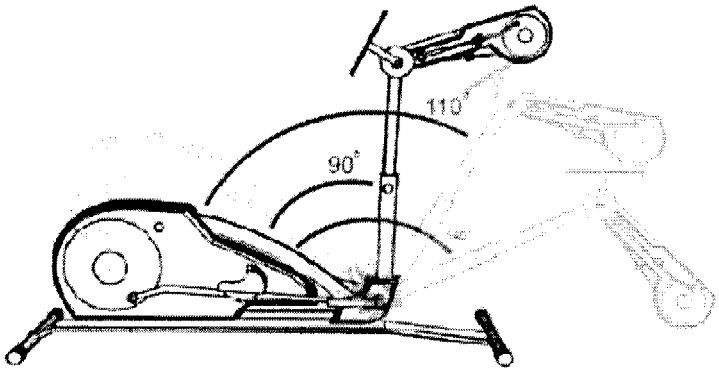
FIG. 5 shows a view of the exercise device with a schematic illustration of various variants of an angle of inclination of a human body from vertical to the ground.
Figures 6, 7:
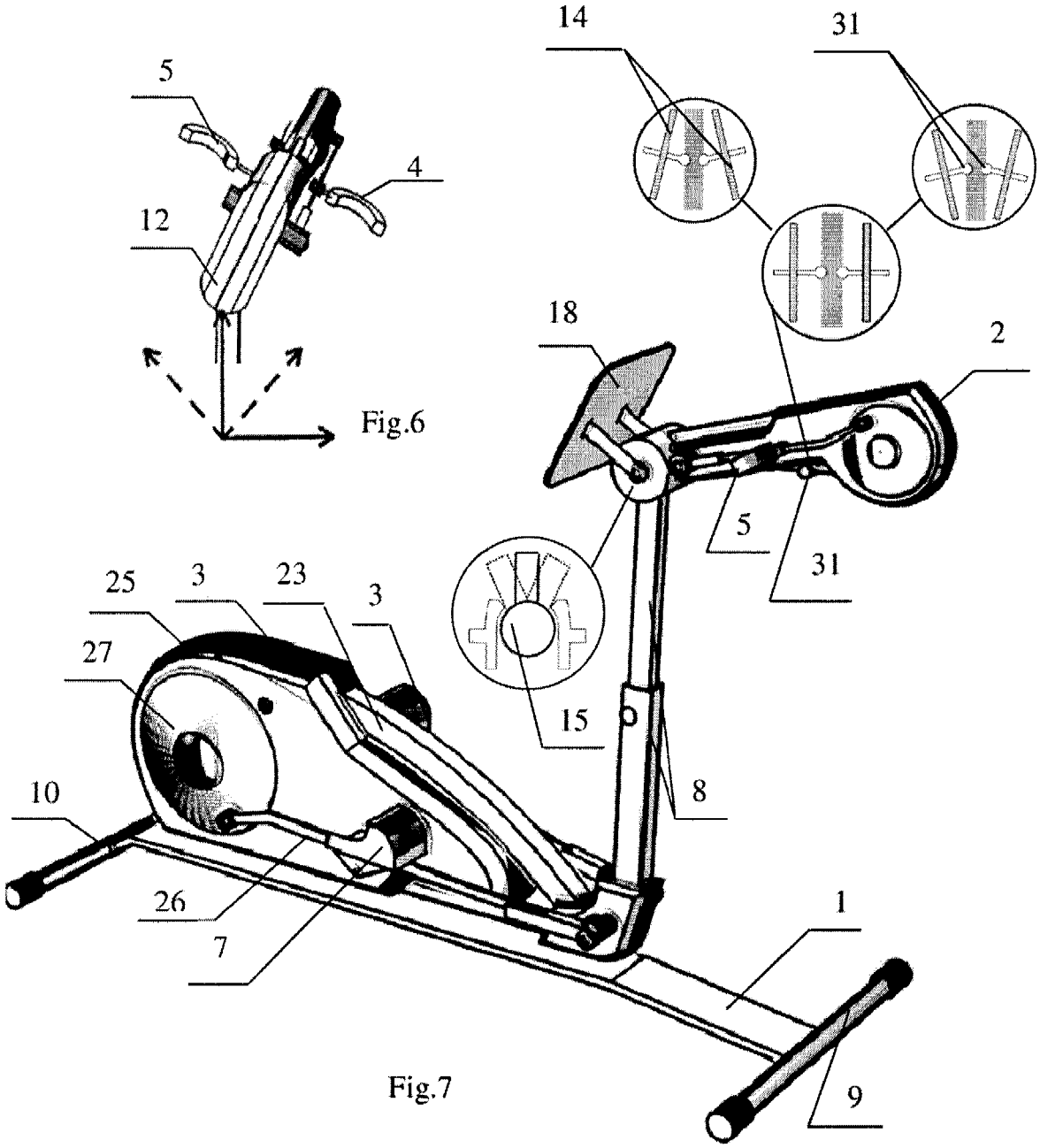
FIG. 6 shows a view of the arm load unit positioned at an angle between the plane of the trajectory of elliptical motions of hands and the sagittal plane of a human body, XZ.
FIG. 7 shows a view of the exercise device detailing the forming an angle between the plane of the trajectory of elliptical motions of hands and the sagittal plane of a human body, XZ.

Various implementations of the present invention and related inventive concepts are described below. It should be appreciated, however, that the present invention is not limited to any particular manner of implementation, and that the various exemplary embodiments illustrated in the Figures and discussed explicitly herein are provided primarily for purposes of illustration to explain the essence of the invention, as well as describe and enable it to be readily understood by those skilled in the art.

The elliptical exercise device for simultaneous training of the shoulder girdle and the pelvic girdle in a human comprises an exercise device body 1, which includes arm load unit 2 and leg load unit 3 whereon a left hand pedal 4 and a right hand pedal 5 and a left foot pedal 6 and right foot pedal 7, respectively, are mounted thereon. The left foot pedal 6 and right foot pedal 7 are configured so as to fix feet in pedals by configurations of fixation known in the art to provide an opportunity for a user to train when the body is inclined from vertical to the ground (towards horizontal position). The exercise device body 1 additionally includes a vertical rack 8, with the upper end being coupled to the arm load unit 2 and the lower end being coupled to the leg load unit 3. Further, the exercise device body 1 comprises a front supporting beam 9 and a back supporting beam 10 to provide uniform positioning of the exercise device on the horizontal plane.

The arm load unit 2 and the leg load unit 3 are designed by any method known in the art so as to provide a possibility for performance of elliptical motions. For example, in the proposed embodiment of the invention, the arm load unit 2 is positioned on a beam 11 which is attached to the upper end of the vertical rack 8. The arm load unit 2 comprises a housing 12, the left hand pedal 4 and the right hand pedal and a connecting rod 13 coupled to a flywheel 14. Thus, the proposed embodiment represents a mechanical elliptical exercise device, however the elliptical exercise device may be made with magnetic, electromagnetic and aeromagnetic load units known in the art.

In addition, the beam 11 is coupled to the vertical rack 8 with either configurations of forming an angle between the plane of the trajectory of elliptical motions of hands and the sagittal plane of a human body, XZ, particularly in this embodiment, with an elastic cylindrical hinge 15 having two degrees of freedom, which allows the beam 11 to deflect in the horizontal plane while a user press hands on hand pedals 4 and 5 (rightwards/leftwards). Further, either configurations of changing an angle of inclination of a human body relative to the horizontal position, which can be designed by methods known in the art, is positioned in the point of junction of the beam 11 and the vertical rack 8. For example, in the proposed embodiment of the invention, it has the form of a screw pair 16. In an alternative embodiment of the invention, there may be mechanical fixation of the vertical rack 8 relative to the beam 11.

In addition, a removable supporting platform 18 having any shape, preferably a rectangular form, is mounted with elastic plates 17 to the upper end of the vertical rack 8. Designing the plates 17 as elastic elements, such as an elastic shelf, facilitates training on the exercise device as a human body receives additional support preferably at the level of chest of a human body or at the level of abdomen. An angle of the removable supporting platform 18 is adjusted with the screw pair 19.

The vertical rack 8 is designed as two tubes 8*a* and 8*b* having different section, interconnected with either configurations of adjusting a distance between roll axes of the arm load unit 2 and the leg load unit 3, which is a telescopic mechanical connection 20. In particular, one of the tubes 8*a* of the rack enters into another tube 8*b* of the rack, the junction of tubes 8*a* and 8*b* is equipped with holes 21 and a screw 22 which fixes tubes 8*a* and 8*b* of the vertical rack 8 at a height required for training. In alternative embodiments, telescopic mechanical connection can be either a mechanical fixing, or a screw pair, or a mechanical gearbox, or a gas cylinder. This is the method to adjust a distance between roll axes of the arm load unit 2 and the leg load unit 3.

The leg load unit 3 is positioned on the frame 23 and is mounted on the lower end of the vertical rack 8 with a configurations of adjusting a distance between roll axes of the arm load unit 2 and the leg load unit 3, being made in the form of the screw pair 24. The leg load unit 3 includes the housing 25, the left foot pedal 5 and the right foot pedal 7 placed on a connecting rod 26 connected to a flywheel 27. The connecting rod 26 also includes either configurations of adjusting a distance between roll axes of the arm load unit 2 and the leg load unit 3, which is the telescopic mechanical connection 28.

The arm load unit 2 as well as the leg load unit 3 are equipped with a configurations of adjusting a distance between the right hand pedal 5, the right foot pedal 7 and the left hand pedal 4, the left foot pedal 6, respectively, being made in the form of a screw pair or another tool known in the art (not shown on Fig.).

The exercise device can be equipped with a configurations to set up kinematic parameters of elliptical motions of hands and feet, designed as a mechanical lock which, at the same time, can be mounted on the flywheel 14 or 27 of the load unit 2 or 3 and on the connecting rod 13 or 26 (not shown on Fig.).

Either configurations of changing an angle of inclination of a human body from vertical to the ground, designed as two expandable tubes 29 connected by configurations of the telescopic connection 30, is additionally positioned between the leg load unit 3 and the exercise device body 1.

Further, additionally in the alternative embodiment of the invention, where the exercise device further comprises a configurations for forming an angle between the plane of the trajectory of elliptical motions of hands and the sagittal plane of a human body, XZ, the load unit for each hand is designed separately and is mounted to a ball joint 31 which provides the possibility of forming an angle of inclination of the rotation axis of the load unit relative to the sagittal plane of a human body, XZ. In this case, the angle of inclination can be changed and, if necessary, be fixed by configurations of a support with variable length mounted on the beam 11 or the frame 23 that slides on the inner surface of the flywheel 14 or 27, respectively (not shown on Fig.).

The exercise device is further equipped with configurations of changing load intensity, designed in a manner known in the art (not shown on Fig) including, for example, magnetic, electromagnetic and others.

The elliptical exercise device works as follows. First, a user, regardless of the level of training background, places feet on the foot pedals 6 and 7, places hands on the hand pedals 4 and 5, and leans on the removable supporting platform 18. The user determines the convenience of placing arms and legs, and adjusts, by configurations of adjusting a distance between axes of the arm load unit and the leg load unit 20 and 28, the positions of hand pedals 4 and 5 and foot pedals 6 and 7 as required depending on the length of arms and legs, and, using a configurations of adjusting a length between the right and left pedals, adjusts the positions as required depending on the width of the shoulder girdle and the pelvic girdle. After that, a user performs elliptical motions by feet and hands simultaneously. If ready or when necessary and depending on the level of user's training background, a user may not lean on the platform 18, and perform elliptical motions by feet and hands only.

During the training, the user can choose the desired load intensity, set up kinematic parameters of elliptic motions of hands and feet.

The user can also choose synchronization of hand and feet motions, for example, synchronous performance: movement of the right arm concurrently with the movement of the right leg and vice versa, etc., or asynchronous performance: movement of the right arm concurrently with the movement of the left leg and vice versa, etc. as well as other known types of movements of limbs in different sequences. Further, when the embodiment of the exercise device with independent load units for the right hand and for the left hand are used, in case of need and depending on the level of user's training, elliptical motions can be performed by one hand (right or left) to work out only muscles of certain parts of the shoulder girdle and trunk. The said feature is important for the development of rehabilitation and training programs to correct spinal curvature, more particularly scoliosis.

Further, in another embodiment of the exercise device, a user can perform exercises by hands, which would simulate motions of cat family members, such as a bobcat, when front limbs do not move in parallel to each other, but rather overlap each other at an angle, with a body being bent, stretched in one direction. Therefore, a user can perform elliptical motions by hands at an angle rather than in parallel to the sagittal plane of a human body, XZ, to increase/decrease the range of traction/stretching exercises of a human body.

The elliptical exercise device can be manufactured in a modern industrial production using standard materials, parts and components.

Therefore, the use of the invention claimed allows to design an elliptical exercise device to train muscles of the trunk, the shoulder girdle and the pelvic girdle in a human with simultaneous simulation of different movement patterns by activating different groups of muscles, joints, locomotor system in a human in general and especially muscles holding the spine with the possibility of adjusting the load intensity during coordination of motor activity (locomotion) of the human body through simultaneous performance of elliptic motions of hands and feet, which, in addition to the load on the shoulder and pelvic girdles, form, at the same time, preferably stretching load on muscles which hold the vertebral spine.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present invention are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present invention.

The invention claimed is:

1. An elliptical exercise device for simultaneous training of a shoulder girdle, a pelvic girdle and trunk muscles in a user, the device comprising an exercise device body including an arm load unit having a first hand pedal and a second hand pedal attached thereto and a leg load unit having foot pedals attached thereto, wherein the arm load unit and the leg load unit are configured to enable the first and second hand pedals and the foot pedals to perform elliptical motions independently from each other, wherein the arm load unit comprises a first flywheel to which the first hand pedal is coupled and a second flywheel to which the second hand pedal is coupled, wherein the first flywheel is mounted to a first ball joint configured to allow the first flywheel to rotate in a first direction parallel to the ground, such that a first angle measured in the first direction is capable of change, the first angle being an angle between a sagittal plane of a human body of the user of the elliptical exercise device and a plane of trajectory of elliptical motions of the first hand pedal, and wherein the second flywheel is mounted to a second ball joint configured to allow the second flywheel to rotate in the first direction, such that a second angle measured in the first direction is capable of change, the second angle being an angle between the sagittal plane of the human body of the user and a plane of trajectory of elliptical motions of the second hand pedal.

2. The elliptical exercise device of claim 1, further comprising a removable supportive platform.

3. The elliptical exercise device of claim 2, wherein the removable supportive platform is configured to be located at the level of the chest segment of the human body of the user.

4. The elliptical exercise device of claim 1, wherein the exercise device is configured to change a third angle measured relative to the ground, the third angle being an angle of inclination of the arm load unit.

5. The elliptical exercise device of claim 1, further comprising a mechanical lock configured to set kinematic parameters of elliptical motions of the first hand pedal, the second hand pedal, and the foot pedals.

6. The elliptical exercise device of claim 1, further comprising a telescopic mechanical connection configured to adjust a distance between the arm load unit and the leg load unit.

* * * * *